United States Patent [19]

Rome et al.

[11] Patent Number: 4,524,952

[45] Date of Patent: Jun. 25, 1985

[54] SAFETY SYSTEM FOR AN OIL WELL DERRICK

[75] Inventors: Gerald F. Rome, Houston; Frank L. Lankford, Jr., Bellaire, both of Tex.

[73] Assignee: Texaco Inc., White Plains, N.Y.

[21] Appl. No.: 611,658

[22] Filed: May 18, 1984

[51] Int. Cl.[3] ..... B66D 1/48; B66D 1/36

[52] U.S. Cl. ..... 254/269; 254/337

[58] Field of Search ..... 254/269, 399, 337, 276

[56] References Cited

U.S. PATENT DOCUMENTS

| | | | |
|---|---|---|---|
| 2,241,274 | 5/1941 | Severson | 254/269 |
| 2,564,457 | 8/1951 | Wilson | 254/269 |
| 2,581,721 | 1/1952 | Sherwood | 254/337 X |
| 3,565,402 | 2/1971 | Linke | 254/269 |

*Primary Examiner*—Stuart S. Levy
*Assistant Examiner*—Katherine Jaekel
*Attorney, Agent, or Firm*—Robert A. Kulason; James J. O'Loughlin; Henry C. Dearborn

[57] ABSTRACT

A safety system for an oil well type derrick that has a crown block and a traveling block and drawworks for raising and lowering the traveling block. It uses electrical sensing means to detect the presence of the traveling block, and it has electronic circuits to control an actuator for braking the drawworks in order to prevent the traveling block from contacting the crown block.

7 Claims, 2 Drawing Figures

SAFETY SYSTEM FOR AN OIL WELL DERRICK

This invention concerns a drilling rig safety system, in general. More specifically, it deals with automatically limiting the travel of a traveling block in an oil well derrick that has a crown block and drawworks for raising and lowering the traveling block.

SUMMARY OF THE INVENTION

It has been recognized that an important safety system on a drilling rig is the arrangement that automatically prevents the traveling block of the rig from accidentally hitting the crown block while the drawworks is hoisting the traveling block. Heretofore, the unit that has been employed is a mechanical sensing and switching system that activates the brake mechanism of the drawworks when the traveling block reaches a present location. A problem encountered with mechanical systems of that sort is a failure of the components due to environmental conditions. In addition, that type system is such that it can be by-passed easily by rig personnel. And, that is often done when it is necessary to raise the traveling block beyond the preset limit. The requirement for going beyond the limit position exists when the length of the bottom hole assembly is such that the traveling block must be carefully raised closer to the crown block in order to clear the rotary table. Under such conditions, if the system is not reactivated the traveling block can hit the crown block and accidents have occurred where the result was to knock the crown block free and cause a collapse with the associated cables falling to the rig floor.

There is a known system that is described in a brochure of a Norwegian company that has a factory at Hamrevegen 10, 5210 Kalandeidet, Norway. Its mailing address: is P.O. Box 245,5051, Nesttun, Norway. That system is pneumatic as to its basic operating controls. While it contemplates warning signals as the traveling block approaches an upper position, and it may cause a shutdown of the drawworks when the upper position has been reached, it is basically a pneumatic system and has the disadvantages thereof.

Consequently, it is an object of this invention to provide a safety system for an oil well derrick or the like that employs electrical sensing means to provide automatic stopping of the drawworks prior to contact of the traveling block with the crown block.

Another object of the invention is to provide a safety system for oil well derricks or the like that includes in connection with its means for releasing the arresting arrangement (so that the traveling block may be carefully raised closer to the crown block) a provision such that thereafter it will automatically reset. Consequently, when approaching the crown block the next time, the safety system will be enabled and ready to act automatically.

Briefly, the invention concerns a safety system for an oil well derrick or the like having a stationary block, a traveling block and drawworks for raising and lowering said traveling block. The said drawworks includes means for stopping movement of said traveling block, and the system comprises electrical sensing means adjacent to said stationary block for sensing the presence of said traveling block, and actuating means for said supportng means. It also comprises circuit means for connecting said electrical sensing means to said actuating means whereby said traveling block may be stopped when sensed in order to avoid contact with said stationary block.

Again briefly, the invention concerns a safety system for an oil well derrick or the like having a stationary block, a traveling block and drawworks for raising and lowering said traveling block within a normal range. The said drawworks includes means for stopping movement of said traveling block, and the system comprises first electrical sensing means adjacent to said stationary block for sensing the presence of said traveling block, and second electrical sensing means located adjacent to a pre-determined lower limit of travel of said traveling block. It also comprises actuating means for said stopping means, and alarm means for warning prior to activating said actuating means. It also comprises first circuit means for connecting said first and second sensing means to said actuating means. Said first circuit means comprises (a) manual means for de-activating said actuating means whereby said traveling block may be released for travel beyond either said first or second sensing means, and (b) means for automatically re-activating said actuating means when said traveing block has returned to said normal range. The system also comprises second circuit means for connecting said first and second sensing means to said alarm means whereby said alarm means will be actuated before said actuating means for said stopping means.

Again briefly, the invention is in a safety system for an oil well derrick or the like having a crown block, a traveling block and drawworks including brake means for stopping said traveling block. The invention concerns the improvement that comprises at least one sensing means for creating an electrical output signal when said traveling block is within a predetermined distance from said crown block, and electronic circuit means for receiving said output signal and actuating brake means. The said electronic circuit means comprises a comparator having an input for said output signal and another input for a reference signal, and said comparator providing a second output signal when said first output signal exceeds said reference signal. The electronic circuit means also comprises a latch having a set input and a clear input and providing a third output signal upon receipt of said second output signal, and an actuator for said brake means having an input for receiving said third output signal.

Again briefly the invention is in a safety system for an oil well derrick or the like having a crown block, a traveling block and drawworks including brake means for stopping said traveling block. In that system the improvement comprises at least two sensing means for creating a first electrical output signal when said traveling block is within a pre-determined distance of one of said sensing means, and electronic circuit means for receiving said first electrical output signal and actuating said brake means. The electronic means comprises (a) a first comparator having an input for said first electrical output signal and an input for a first reference signal, and (b) a second comparator having an input for said first electrical output signal and an input for a second reference signal. The electronic circuit means also comprises (c) alarm means actuated by the output of said second comparator when said first electrical output signal exceeds said second reference signal for warning the approach of said traveling block to one of said sensing means, and (d) an actuator for said brake means actuated by the output of said first comparator when said first electrical output signal exceeds said first reference signal for braking said drawworks. It also comprises (e) first and second latches connected to the output of said first comparator, and (f) means for connecting the output of said first latch to said actuator for braking said drawworks and stopping said traveling block. It also comprises (g) an inverter between said first comparator and said second latch, and (h) an override switch connected to said second latch. Also, (i) the output of said second latch is connected to said first latch whereby said override switch may deactivate said actuator and release said traveling block for travel beyond said sensing means.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

Figure 1:
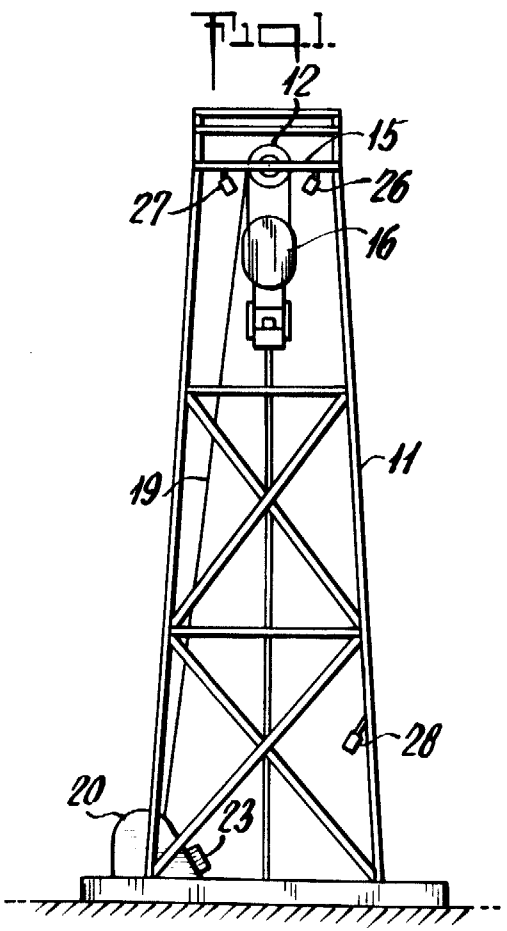
FIG. 1 is a schematic illustration of a drilling rig with drawworks for the raising and lowering of a traveling block and including sensors for use in a safety system according to the invention.

It will be appreciated that a safety system according to this invention may be applicable to other and different derricks wherein a stationary block is employed with a traveling block and having drawworks for adjusting the position of the traveling block relative to the stationary block. However, a preferred embodiment of the invention is applicable to an oil well derrick in particular. With reference to the drawings it will be observed that a derrick 11 has a crown block 12 at the top thereof. Crown block 12 is mounted on a stationary support member 15. There is a traveling block 16 which may be raised and lowered by a cable 19 under a control of a drawworks 20. It will be appreciated that the drawworks 20 includes a brake (not shown) with an actuator 23 that controls the brake for stopping the vertical movement of the traveling block 16. It will be appreciated that these elements of an oil well derrick are well known in the art and they might take various different specific forms.

There have been accidents which resulted in personal injury and severe rig damage as well as rig down time. Some of such accidents were due to problems encountered with the safety system or systems which were known and used heretofore. In the known prior safety arrangements, there were mechanical sensing and switching elements to activate the brake mechanism on the drawworks. A problem encountered with such mechanical systems has been failure of components due to environmental conditions. Another problem has been the fact that such systems may be easily by-passed by rig personnel when it becomes necessary to raise the traveling block beyond the mechanical set limit of the system. Thus, it is often required that the traveling block be raised beyond a safety cut-off location, e.g., when the length of the bottom hole assembly is such that the traveling block must be carefully raised close to the crown block in order to clear the rotary table. When such an operation was carried out heretofore, the safety system had to be by-passed and if the system was not reactivated afterward the traveling block could hit the crown block. Some accidents have occurred where the crown block has been knocked free from the derrick, and it and the traveling block and associated cabling have fallen to the rig floor.

Again referring to the drawings, there are two sensors 26 and 27 located near the crown block 12 in order to sense the presence of the traveling block 16. Also, another sensor 28 is located near the lower end of vertical travel of the traveling block 16 in order to provide the automatic warning and stopping of the traveling block at the lower end of its desired travel. It will be appreciated that these sensors 26, 27 and 28 might take different forms. However, preferably they are magnetic type sensors which provide an electrical output signal caused by the presence of the traveling block 16 reaching a given proximity. It may be noted that when the terms electrical sensor are employed herein it is intended to encompass a magnetic type sensor that provides an electrical signal output, e.g. like the sensors 26, 27 and 28 just described. Also, while two sensors 26 and 27 are located near the crown block 12, it will be understood that one would be able to provide signals in order to carry out the action of the safety system according to the invention. However, use of two provides a safety redundancy which adds the ability to continue to develop a signal even if one of the sensors should become inoperative.

Figure 2:
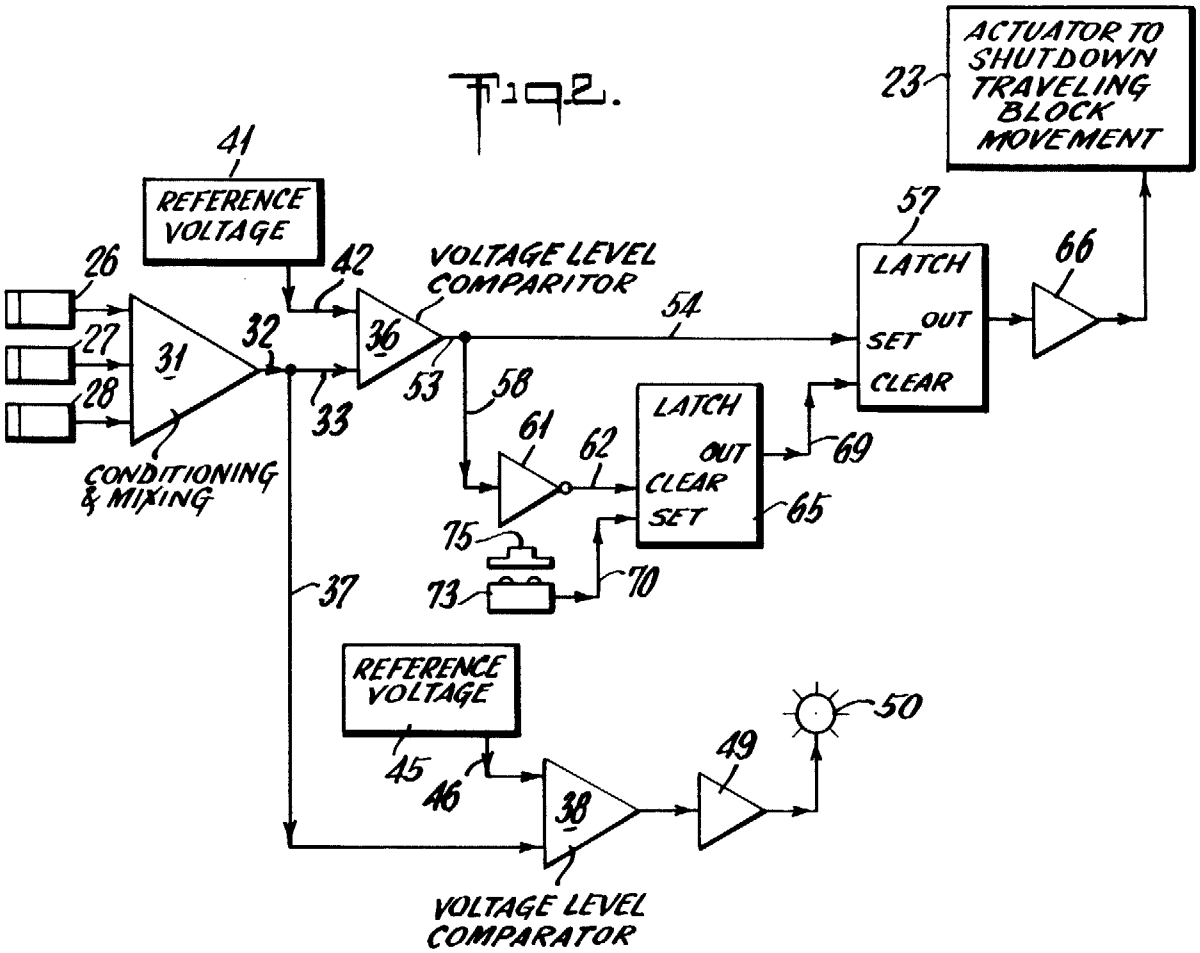
FIG. 2 is a schematic circuit diagram illustrating electronic circuit elements for carrying out a safety control procedure according to the invention.

FIG. 2 illustrates a preferred embodiment of an electronic circuit arrangement for carrying out the operation of a safety system according to the invention. There is a conditioning and mixing circuit 31 that receives inputs from the three sensors 26, 27 and 28. An output element 32 from the mixing and conditioning element 31 branches so that it goes via an input circuit 33 to a first voltage level comparator 36. The other branch of circuit 32 goes via an input circuit 37 to a second voltage level comparator 38. The first comparator 36 has a reference voltage source 41 connected to its other input circuit 42. Similarly, there is a reference voltage source 45 that is connected to another input circuit 46 of voltage comparator 38. Comparator 38 has an output that goes via a driver or amplifier 49 which drives an alarm 50. It will be understood that the alarm 50 may take any feasible form including a light and/or a bell etc.

It may be noted that the voltage supplied by reference voltage element 45 is lower in amplitude than the reference voltage from the source 41. This is done so that the alarm 50 will be actuated first before the traveling block 16 is stopped by reason of the action when the signal amplitude has increased to the amplitude of the reference voltage supplied by source 41.

There is an output circuit 53 from the comparator 36 which divides into an input circuit 54 of a first latch 57. The other branch from output circuit 53 goes via an input circuit 58 to an inverter 61. There is an output circuit 62 from the inverter 61 which goes to one input of a second latch 65.

The output of the first latch 57 goes to a driver or amplifier 66 that is connected to the actuator 23. Actuator 23 controls the braking means in order to stop the drawworks and hold the traveling block 16 at a given position.

The second latch 65 has an output circuit 69 that goes to another input of the first latch 57. As indicated by the captions, the input circuit 54 to the latch 57 is a "set" signal input while the circuit 69 from the second latch 65 goes to a "clear" input of the latch 57.

The latch 65 has one input via the output circuit 62 from the inverter 61 which goes to its "clear" input, while there is another input circuit 70 that connects a manual override switch unit 73 to the "set" input of the latch 65.

OPERATION

When the traveling block 16 approaches either the sensing unit 28 or the sensors 26 and 27, the voltage input to comparator 36 via input circuit 33 is compared with the reference voltage from the source 41. Then when the voltage from the sensor or sensors exceeds the reference voltage from source 41, the output from comparator 36 snaps from a low to a high. That signal is transmitted via the output circuit 53 and input circuit 54 to set the latch 57. When the latch 57 is set it causes an output via the driver 66 to go to the actuator 23. Consequently actuator 23 shuts down the traveling block 16 via the brake (not shown) on the drawworks 20.

At the same time, the "high" signal output from the comparator 36 also enables the latch 65. That action is via the circuit 58 and inverter 61 and then via the output circuit 62 which goes to the "clear" input of the latch 65. This renders the manual override switch unit 73 effective so that if it is desired to release the traveling block 16 for further movement beyond either stop point, a spring biased contact switch 75 may be actuated. That provides a signal over the input circuit 70 to the "set" input of the latch 65. When the latch 65 is set it provides an output over the circuit 69 to clear the latch 57. Consequently the actuator 23 is relaxed and the traveling block 16 may be cautiously moved further.

Thereafter, if the traveling block 16 is moved back into the operating range i.e., to a safe position, the input signal from the sensor or sensors via the conditioning and mixing circuit 31 is reduced to less than the output of the reference voltage source 41. Consequently the output of the comparator 36 goes low. When the output of comparator 36 goes low, the latch 65 is disabled or cleared by the high signal on the circuit connection 62 from the inverter 61. In this manner the override switch unit 73 is automatically disabled so that the traveling block can not be inadvertently moved beyond its protected limits. At the same time the first latch 57 is activated and ready to receive the next signal from one of the sensors 26, 27 or 28.

The output signal on circuit 32 from conditioning and mixing unit 31 also goes via the input circuit 37 to the comparator 38 where the second reference voltage unit 45 provides a reference voltage via the input circuit 46. As noted previously, this reference is a lower amplitude than the reference voltage from unit 41. Therefore, the output from the comparator 38 will snap into a high signal at an earlier point in the approach of the traveling block 16 to either of the sensors at the top or bottom of the travel. That high signal via the driver 49 will cause the alarm 50 to be actuated before the system causes a shutdown signal for braking the drawworks.

It will be understood by anyone skilled in the art that particular circuit detail for the various elements employed might vary depending on design choice. Thus, the circuits would be designed using standard electronic circuits. Also, it may be noted that the sensor units or elements 26, 27 and 28 might take different forms but are preferably magnetic units which provide an electrical output signal upon approach of the traveling block into a proximate position relative to a sensing unit.

While a particular embodiment of the invention has been described above in considerable detail in accordance with the applicable statues, this is not to be taken as in any way limiting the invention but merely as being descriptive thereof.

We claim:

1. Safety system for an oil well derrick or the like having a stationary block, a traveling block and drawworks for raising and lowering said traveling block within a normal range, said drawworks including means for stopping movement of said traveling block, comprising first electrical sensing means adjacent to said stationary block for sensing the presence of said traveling block, second electrical sensing means located adjacent to a predetermined lower limit of travel of said traveling block, actuating means for said stopping means, alarm means for warning prior to activating said actuating means, first circuit means for connecting said first and second sensing means to said actuating means, said first circuit means comprising (a) manual means for deactivating said actuating means whereby said traveling block may be released for travel beyond either said first or second sensing means, and (b) means for automatically reactivating said actuating means when said traveling block has returned to said normal range, second circuit means for connecting said first and second sensing means to said alarm means whereby said alarm means will be actuated before said actuating means for said stopping means.

2. In a safety system for an oil well derrick or the like having a crown block and drawworks including brake means for stopping said traveling block, the improvement comprising at least one sensing means for creating a first electrical output signal when said traveling block is within a predetermined distance from said crown block, and electronic circuit means for receiving said first output signal and actuating said brake means, comprising a comparator having an input for said first output signal and another input for a reference signal, said comparator providing a second output signal when said first output signal exceeds said reference signal, a latch having a set input and a clear input and providing a third output signal upon receipt of said second output signal, and an actuator for said brake means having an input for receiving said third output signal.

3. In a safety system according to claim 2, wherein the improvement comprising said electronic circuit means also comprises a second comparator having an input for said first output signal and another input for another reference signal having an amplitude less than said first named reference signal, said second comparator providing a fourth output signal when said first output signal exceeds said second reference signal, and an alarm actuated by said fourth output signal.

4. In a safety system according to claim 3, wherein the improvement comprising said electronic circuit means also comprises a second latch having a set input and a clear input and providing a fifth input signal, override signal means connected to said second latch set input, an inverter connected between said first comparator and said second latch clear input, and means for applying said fifth output signal to said first latch clear input to deactivate said actuator.

5. In a safety system for an oil well derrick or the like having a crown block, a traveling block and drawworks including brake means for stopping said traveling block, the improvement comprising at least two sensing means for creating a first electrical output signal when said traveling block is within a predetermined distance of one of said sensing means, and electronic circuit means for receiving said first electrical output signal and actuating said brake means, comprising (a) a first comparator having an input for said first electrical output signal, an input for a first reference signal, and an output, (b) a second comparator having an input for said first electrical output signal, an input for a second reference signal, and an output, (c) alarm means actuated by the output of said second comparator when said first electrical output signal exceeds said second reference signal for warning the approach of said traveling block to one of said sensing means, (d) an actuator for said brake means actuated by the output of said first comparator when said first electrical output signal exceeds said first reference signal for braking said drawworks, (e) first and second latches connected to the output of said first comparator, each latch having an output, (f) means for connecting the output of said first latch to said actuator for braking said drawworks and stopping said traveling block, (g) an inverter between said first comparator and said second latch, and (h) an override switch connected to said second latch, (i) the output of said second latch connected to said first latch whereby said override switch may deactivate said actuator and release said traveling block for travel beyond said sensing means.

6. In a safety system according to claim 5, wherein said sensing means are magnetic.

7. In a safety system according to claim 6, wherein at least one of said magnetic sensing means is located adjacent to said crown block, and another of said sensing means is located adjacent to a lower limit position of said traveling block.

* * * * *